US008308509B2

(12) United States Patent
Karam

(10) Patent No.: US 8,308,509 B2
(45) Date of Patent: Nov. 13, 2012

(54) MULTIPLE-POSITION MODULAR CONNECTOR EMPLOYING SHIELDED OR FILTERED SIGNAL CONDUCTORS FOR REDUCING ELECTRICAL NOISE

(75) Inventor: Roger A. Karam, Mountain View, CA (US)

(73) Assignee: Cisco Technology, Inc., San Jose, CA (US)

( * ) Notice: Subject to any disclaimer, the term of this patent is extended or adjusted under 35 U.S.C. 154(b) by 125 days.

(21) Appl. No.: 12/611,398

(22) Filed: Nov. 3, 2009

(65) Prior Publication Data

US 2011/0104942 A1 May 5, 2011

(51) Int. Cl.
*H01R 9/05* (2006.01)

(52) U.S. Cl. ..... 439/579; 439/676

(58) Field of Classification Search ..... 439/578, 439/579, 676

See application file for complete search history.

(56) References Cited

U.S. PATENT DOCUMENTS 5,730,623 A * 3/1998 Krantz et al. ..... 439/580
5,971,813 A 10/1999 Kunz et al.
6,290,538 B1 * 9/2001 Pocrass ..... 439/578
6,336,830 B1 * 1/2002 Lee ..... 439/676
6,375,514 B1 * 4/2002 Chih et al. ..... 439/676
6,461,200 B1 * 10/2002 Shi et al. ..... 439/676
6,508,677 B1 * 1/2003 Wang ..... 439/676
6,837,741 B2 * 1/2005 Kuwahara ..... 439/497
7,384,300 B1 * 6/2008 Salgado et al. ..... 439/489
2008/0311797 A1 * 12/2008 Aekins ..... 439/676

* cited by examiner

*Primary Examiner* — Hien Vu
(74) *Attorney, Agent, or Firm* — BainwoodHuang

(57) ABSTRACT

A multiple-position modular connector (jack, plug or both) includes a rigid insulating body and a set of spaced-apart coaxial conductors carried by the body. Each coaxial conductor has a mating end at a mating portion of the body providing electrical connection between the inner signal conductor and a corresponding conductor of a mating modular connector. A conductive structure extends between the outer shield conductors of the coaxial conductors and a reference contact at an outer surface of the body to provide a high-frequency ground for the outer shield conductors. In another aspect, a modular connector includes a printed circuit board carried by an insulative body and employing some combination of well-matched conductive paths and filtering circuitry such as common-mode coils or "chokes". Electrical traces of the printed circuit board may include ground/reference traces interspersed among signal traces to provide shielding and uniform electrical characteristics to the signal traces. Filtering circuitry when present is disposed on the PC board along the signal traces and acts to reduce the level of common-mode signal components reaching the mating contacts from the cable.

6 Claims, 7 Drawing Sheets

MULTIPLE-POSITION MODULAR CONNECTOR EMPLOYING SHIELDED OR FILTERED SIGNAL CONDUCTORS FOR REDUCING ELECTRICAL NOISE

BACKGROUND

The invention is related to the field of multiple-position modular connectors used in digital data transmission such as transmission over unshielded twisted pair (UTP) cables.

Data communications devices make common use of UTP cable for high-speed digital data transmission. Data is transmitted in a differential fashion over each of one or more twisted pairs of a multiple-pair cable, such as four-pair Category 5 or Category 6 UTP cable. The mechanical and electrical interface between the cable and a device is often made via a multiple-position modular connector, commonly referred to as an "RJ45" connector for example. The connector includes a female jack with multiple conductors (e.g., 8) extending into a cavity, and a corresponding male plug with conductive contacts that made with the conductors of the jack when the plug is inserted into the cavity. A lever or similar mechanical lock holds the plug securely in place. Typically the jack is affixed to the data communications device (e.g., a computer or network switch) and the plug is affixed at an end of a cable which is carrying the data signals between the device and other equipment.

Over time, various advances have made it possible to send data over UTP and STP (shielded twisted pair) cables at increasingly high rates. Currently there is a specification for sending data at 10 Gb/s over four UTP pairs and four STP pairs, which corresponds to a signaling rate of 2.5 Gb/s on each pair. The communications links are susceptible to high-frequency noise, such as from wireless telephones, cell phones, etc. In these systems the noise margins for proper operation are very small, on the order of tens of millivolts. Generally, the links employ suitable circuitry and mechanical configuration to provide proper high-frequency operation in the presence of such noise. Although the RJ-45 style modular connector was not created with such high-frequency operation in mind, and therefore may unduly contribute to noise in a high-data-rate communications link, it is still specified for use even on such links for a variety of reasons.

BRIEF DESCRIPTION OF THE DRAWINGS

Objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Brief Overview

Figure 1:
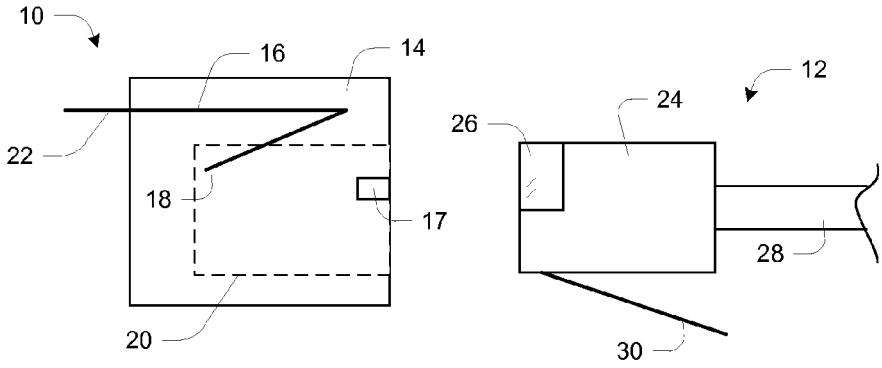
FIG. 1 is a schematic side view of a modular jack and plug.

High speed data transfer requires strict signal integrity design. The data communications industry has opted to keep the RJ45 connector pinout map the same for reasons beyond the scope of this disclosure. Many manufacturers have attempted to work on certain signal-related weaknesses of the RJ45 with clever design techniques, and have been able to make some improvements to the electrical performance including reduction of differential crosstalk among pairs. Return loss of each pair, common-mode to differential-mode conversion on each pair (balance), and common-mode to differential-mode crosstalk among pairs are a few more problems to deal with and solving all of them remains a challenge. While many of these compensation techniques have improved the performance of some of these problems, no single technique seems to solve all of them at the same time. The presently disclosed technique has a good chance of solving all of these problems while achieving the goal of keeping the RJ45 backward compatible (all the conductor pinouts as assigned in legacy RJ45 interfaces remain in the same location). Also the plug would be able to work with the current RJ45 and legacy RJ45 connectors, but using an enhanced RJ45 and an enhanced plug combination as described herein would give superior electrical performance. A customer may change a patch panel to upgrade RJ45s to the enhanced coaxial RJ45 and purchase patch cords with the enhanced plug. Potential energy savings would be gained in addition to the improved electrical performance of the link both in data reception and noise immunity improvements that are very critical. The energy savings would result from the reduction in processing required to solve the signal problems requiring intense digital processing techniques while in fact the source of the problem is in the physics of the connector.

In one aspect, the present disclosure is direct to the use of coaxial conductors or similar techniques of shielded transmission lines to form the conductors in a multiple-position modular connector (jack, plug or both). Generally, a connector element includes a rigid insulating body having a mating portion configured to permit mating with a mating modular connector, and a set of spaced-apart coaxial conductors carried by the body. Each coaxial conductor has an inner signal conductor surrounded by an outer shield conductor, and each coaxial conductor has a mating end at the mating portion of the body which is configured to provide for electrical connection between the inner signal conductor and a corresponding conductor of the mating modular connector. The connector element further includes one or more conductive structures extending between the outer shield conductors of the coaxial conductors and one or more reference contacts at an outer surface of the body, which may be used to provide a high-frequency ground for the outer shield conductors.

In another aspect, the disclosure is directed to the use of a printed circuit board (or a flex circuit board) within a modular connector such as a jack or plug, employing some combination of well-matched conductive paths and potential filtering circuitry such as common-mode coils or "chokes". The printed circuit board or its equivalent is carried by an insulative body and includes (i) a first end with connections to mating contacts of the plug, (ii) a second end with connections to respective conductors of a multiple-twisted-pair cable, and (iii) a set of electrical traces providing connections between respective connections of the first and second ends. The electrical traces may include ground/reference traces interspersed among signal traces so as to provide shielding and uniform electrical characteristics to the signal traces, reducing imbalance that can contribute to differential noise. When the filtering circuitry is present, it is disposed on the PC board along the traces and acts to reduce the level of common-mode signal components reaching the mating contacts from the cable.

There are at least two types of RJ45 connectors. The first is used at a patch panel for interconnectivity (referred to as connecting hardware), and the second is used at an end device such as a network switch. The patch panel RJ45 usually is equipped with an insulation displacement (IDC) connector where a cable is mated to the RJ45. The RJ45 in an end device has extended pins or terminals that can be either through-hole type or surface mount, and it may contain a magnetic (transformer) inside of it or simply exist as a standalone connector. There are two types of plugs, shielded and unshielded. The shielded plug connects to a system ground via two tab-like contacts on the side of the RJ45.

DESCRIPTION OF EXAMPLE EMBODIMENTS

FIG. 1 is a quasi-schematic side view of a mating pair of modular, multiple-position connector elements, namely a jack 10 and plug 12. These are of the type commonly referred to as "RJ45" connection. The jack 10 includes an insulative body 14 supporting an array of conductors 16 (extending into plane of FIG. 1, and thus only one appearing in the side view) of a springy conductive material, with a mating portion 18 extending into an internal cavity 20. A back-end portion 22 of the conductors 16 extends outside the body 12 for attachment to conductors of a separate cable or printed circuit board (not shown). Either or both the jack 10 and plug 12 may be surrounded by a conductive shield, and there may be conductive contact points 17 (such as in the form of inward-facing tabs) that provide for connection between the shield of the jack 10 and the shield of the plug 12.

The plug 12 includes an insulative body 24 supporting a corresponding array of conductive contacts 26 (likewise extending into plane of FIG. 1) which are connected to corresponding conductors of a multi-conductor cable 28, such as unshielded twisted pair (UTP) cable (or a shielded twisted pair). A lever 30 extends from the body 24 in a hinged fashion, being shown in FIG. 1 in a relaxed position furthest away from the body 24.

In the jack 10, each conductor 16 is typically a single solid wire made into a suitable shape before being incorporated into the body 14 of the jack 10. The wire may be of a suitably conductive and springy alloy, such as an alloy of nickel, and is typically gold-plated for improved electrical performance. For infrastructure type of jacks (patch panel connecting hardware), the contacts 22 may be so-called "insulation displacement contacts" or IDCs each having a fork-like portion that engages a wire of a UTP cable. For end devices, each conductor 16 extends out and is soldered onto a PCB connecting to an isolating magnetic. In the plug 12, each contact 26 is normally of a solid conductive material and typically gold-plated as well. The plug is designed to be crimped using a special tool, and contacts 26 are forced into the center conductors of the UTP or STP cable after they have been separated into individual wires and inserted into the plug housing in the expected legacy order.

Figure 2:
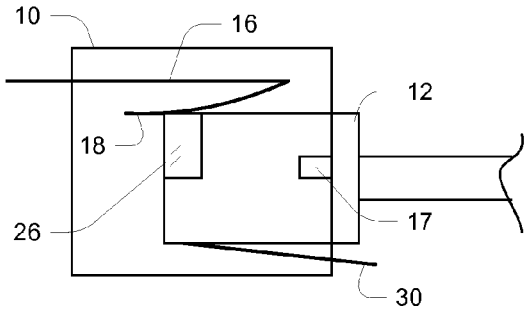
FIG. 2 is a schematic side view of modular jack and plug as mated together.

FIG. 2 shows the jack 10 and plug 12 in a mated position, in which the plug 12 resides within the cavity 20 of the jack 10. The lever 30 rests against an inner surface of the body 14 of the jack to lock the plug 12 in place. The mating portion 18 of the conductors 16 are deflected slightly upward and each rests against a corresponding contact 26 of the plug 12 with a contact force created by the flexing of the mating portion 18. If the plug 12 is of the shielded type (can be connected to a UTP or STP [shielded twisted pair]) then the shield of the plug 12 may make contact at the two contacts 17 on the sides of the jack 10.

Figure 3:
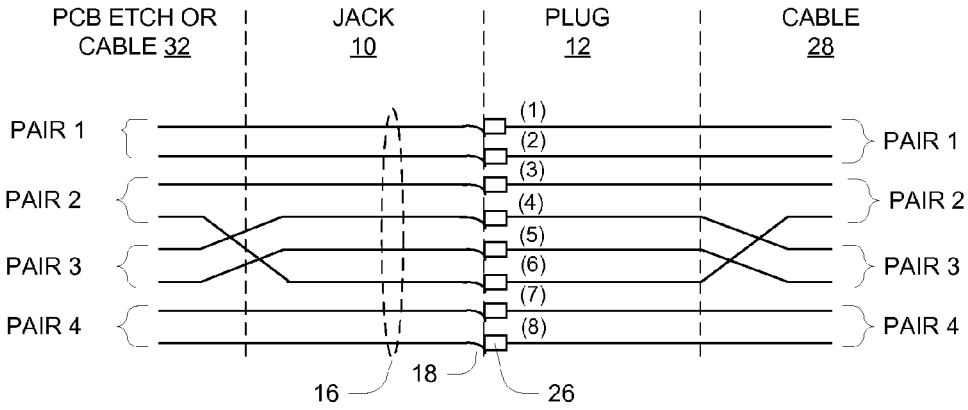
FIG. 3 is a schematic top view of a modular jack and plug as mated together.

FIG. 3 presents a schematic top view of the connections formed by the mated jack 10 and plug 12. In the illustrated configuration it is assumed that the jack 10 and plug 12 are 8-position connectors, although connectors with more or fewer positions and conductors may also be used. The cable 28 attached to the plug 12 is four-pair UTP cable, with the four twisted pairs arbitrarily identified as PAIR 1, PAIR 2, PAIR 3 and PAIR 4. The jack 10 has back-end connections to conductors 32 of either a printed circuit board (PCB etch, or a flex PCB) or another twisted-pair cable (such as at a rear of a patch panel), which for convenience are also labeled as PAIR 1, etc. It will be appreciated that the conductors 32 carry high-speed differential electrical signals in use, and therefore the conductors of each pair are normally matched to a high degree in their physical and electrical characteristics. Also, each wire within each pair would be at a fixed distance from the other wire to control the impedance (as noted that would be missing in the case of pair 2 due to the separation of pins 3 and 6) other critical design rules would be that each wire in a pair would see and equivalent load or parasitics for balance, including for example being routed together on the same or adjacent layers of a PC board.

On the jack 10 and plug 12, the conductors 16 and contacts 26 are arranged in a linear array, with positions numbered (1) through (8) as shown in FIG. 3. By one widespread convention, the four pairs of connections are identified as residing at the following positions:

1. (1, 2)
2. (3, 6)
3. (4, 5)
4. (7, 8)

To meet the above convention in legacy RJ45 connections, it is necessary to cross conductors of PAIR 2 and PAIR 3 in the manner shown in FIG. 3, i.e., one conductor of PAIR 2 is crossed over both conductors of PAIR 3 in order to bring PAIR 3 to the (4,5) positions and to bring the second conductor of PAIR 2 to the (6) position. On the plug side, this crossover is normally accomplished at the very end of the cable 28 right at the mechanical interface to the plug 12, using an "untwist" of the pairs that leads to noise immunity problem, worse impedance control, and lack of balance. That is, the two conductors of PAIR 2 may be separated and one conductor crossed over the conductors of PAIR 3. On the jack side, the crossover may be accomplished within the conductors 32, or it may be accomplished within the jack 10 by suitable mechanical configuration of the conductors 16 past the plug-side interface of the RJ45.

As discussed above, at sufficiently high operating frequencies the jack 10 and plug 12 may contribute to increased noise that can interfere with proper data reception. At minimum, lack of impedance control, increase susceptibility to noise, and local (at the connector-interface noise generation) are due to the limitations imposed on the link and data transfer quality because of the nature of the RJ45 physical aspects. Several aspects of the jack 10 and plug 12 may contribute. One aspect is the non-matched treatment of PAIR 2 required to meet the convention of terminating this pair at positions (3, 6). This mismatch can result in an increased differential-mode noise component. Another problem is the linear arrangement of unshielded conductors in the jack 10 and plug 12, which causes the outer conductors (positions 1 and 8) to have different characteristics from the inner conductors (positions 2-7). Additionally, especially within the jack 10 but also to some extent in the plug 12, the overall length and routing of the conductors (e.g. conductors 16) may create susceptibility to deleterious radiative coupling and/or transmission line effects. The cable acts like an antenna and is efficient at picking up common mode noise from RF sources. Once the common mode noise reaches the RJ45 connection, it changes character, and new noise may result from a phenomenon known as "common-mode to differential-mode conversion" or CM-DM conversion, which refers to the appearance of a differential-mode signal component across the two conductors of a pair in response to imposition of the same (common-mode) noise signal onto both conductors of the pair. CM-DM conversion occurs when there is a mismatch between important parameters of two conductors of an otherwise matched differential pair (e.g., differences of resistance, inductance, and stray capacitance).

Figure 4:
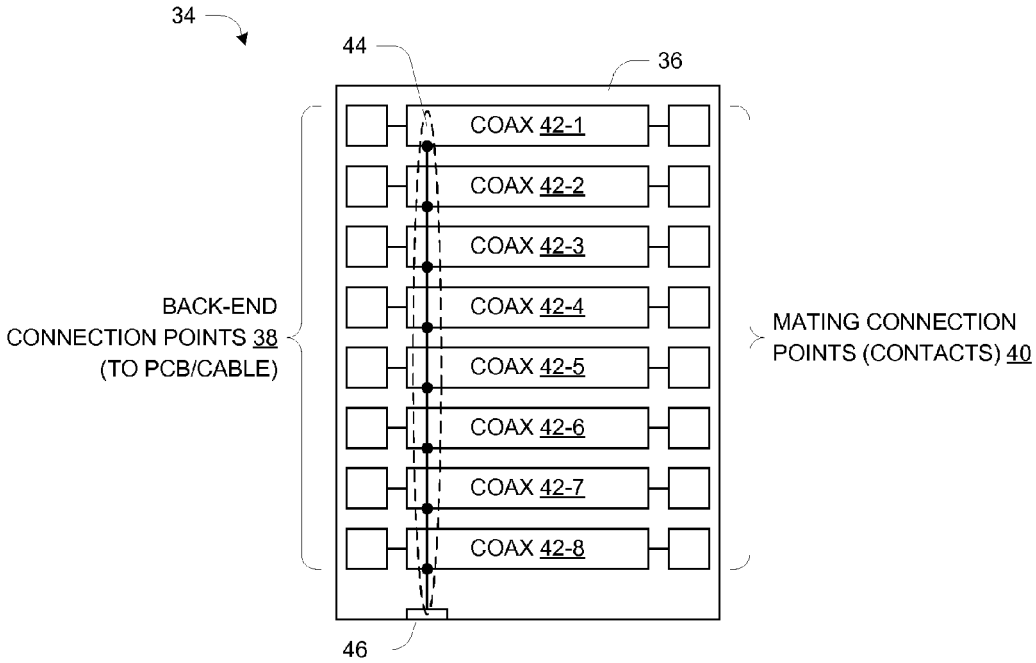
FIG. 4 is a schematic depiction of a connector employing coaxial conductors.

FIG. 4 is a schematic view of a connector 34 having features that reduce mismatches of the type that contribute to noise, including CM-DM conversion. It is the CM-DM conversion that wreaks havoc with data signals since common mode interference of unknown origin and characteristics, now differential in nature mixes with the data signals causing increase in the error rate and potentially disrupting data transfer totally. The connector 34 may be either a jack or a plug, and specific examples of each are provided below. In general, the connector 34 includes an insulative body 36 which supports back-end connection points 38, mating connection points 40, and a plurality of miniature coaxial conductors 42 (shown as COAX 42-1 through 42-8), in which the center conductor of each coax 42 makes a connection between a given back-end connection point 38 and a respective mating connection point 40. The back-end connection points 38 provide connections to PCB/cable conductors 32 or 28 (see FIG. 3), while the mating connection points 40 provide connection to a mating connector when present (i.e., connection points 40 on a jack provide connections to corresponding connection points 40 on a plug, and vice-versa). The mating connection points 40 correspond to the contacts 26 for a plug and to the mating portions 18 of the conductors 16 for a jack. The center conductor of the coax must be exposed to enable the plug to mate to the intended electrical contact at a distance from interface 40.

Figure 18:
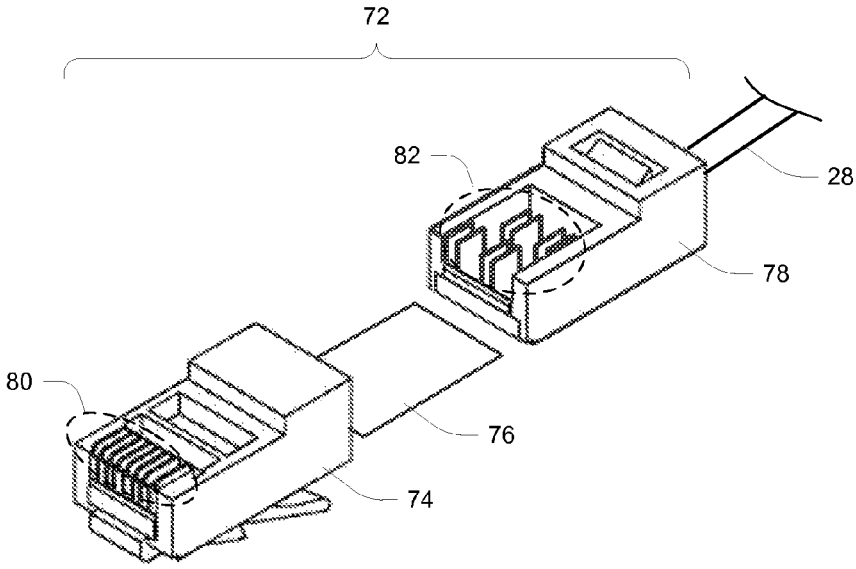
FIG. 18 is a diagram of a plug formed of front and rear housings and a PC board or coaxial conductors.

While the connection points 38 for a plug can be a through hole connection on insulating or PCB material where the center of conductor of each coax would make contact with the center conductors of the wires in a cable, one approach here may be the use of a crimped-like method that is currently deployed for forcing contacts similar to the contacts 26 of FIG. 2 (also shown as a first set of terminals in FIG. 18 below) to gain access to the conductors of the attached cable (as done today), with one addition, the ground itself is used to provide a shield among the forks of the contacts 26 of FIG. 2 for better electrical isolation. Another approach would be to use the same crimping methodology but to stagger the contacts 26 in distance to provide pair to pair isolation, as also shown in FIG. 18 and discussed below. If such a crimping technique is used, then retrofitting the cables in the field with this new connector becomes easy. One would cut the existing plug of the cable and insert the four pairs into the new interface at connections 38 and crimp the new plug in place, where the new plug without a PCB (and with a PCB-ground approach as shown later) would cross pair 2, and deliver shielding among pairs, impedance control and all the high signal integrity quality the link calls for. In the case of a PCB based plug the crossover of pair 2 would be done on the PCB. The PCB, flex circuit or a hybrid (or potentially the center conductor of the coax itself) may be deployed here and at the current location of 26 would be automatically connected in manufacturing so the only connection needed is to use a crimping tool to gain access to the conductors in the cable at 38. Also a hybrid of a coax and PCB approach may be deployed.

While the cable interface is shown to have similar crimping approach to legacy crimping methods, other innovation may be possible to solve this problem while keeping the pairs untwisting to a minimum.

The outer or shield conductor of each coax 42 is connected to a conductive structure 44 which provides a high-frequency ground. For example, the conductive structure 44 may connect to one or more contacts 46 which in turn are connected to a high-frequency ground on a PC board or other system component to which the connector 34 is mechanically coupled in use. The connection may be through a metal shield which forms an outer surface of the connector 34. Specific examples of such configurations are discussed below. In some cases the conductive structure may employ DC coupling to the high-frequency ground, while in others it may employ AC coupling such as through one or more series capacitors.

It will be appreciated that by use of the coax 42, each signal conductor is provided with its own shielding and all conductors can be highly matched in terms of parasitic resistance and reactive values, thus contributing to a reduction of noise. It may also be desirable to perform any necessary cross-over using the coax 42 rather than within the cable 28 or conductors 32. With the shielding provided by the outer conductor of each coax 42, there is less coupling that can contribute to noise. With the coax approach, return loss on each pair, cross talk among pairs, balance and CM-DM conversion are all taken care of.

FIGS. 5-8 are side schematic views of different possible configurations of a jack 48 (shown as jacks 48-1 through 48-4) according to the general configuration of FIG. 4. In the jack 48-1 of FIG. 5, the coax 42 is embedded near the top of the body 36, and exposed areas 50, 52 of the center conductor form the back-end and mating connection points 38, 40 respectively. The back-end mating connection points 38 are configured for connection to the PCB/cable connections 32 (see FIG. 3), and the mating connection points 40 are configured to extend into cavity 49 (indicated by dotted line) to contact corresponding mating connection points of a separate plug (not shown), such as the mating configuration shown in FIG. 2.

Figure 5:
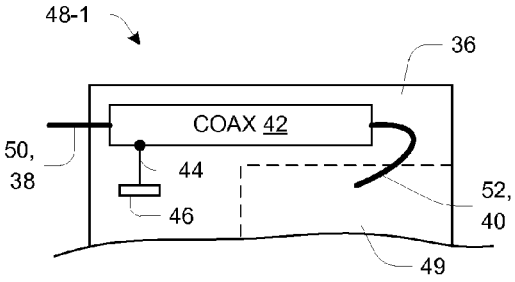
FIGS. 5-8 are schematic side views of a modular jack employing coaxial conductors.
Figure 7:
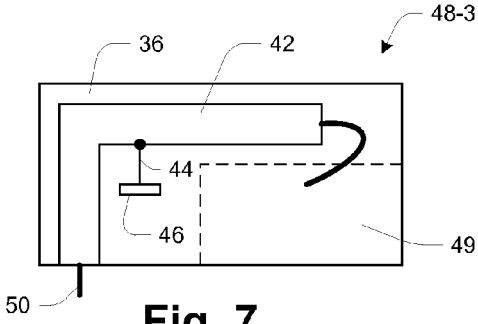
Figure 6:
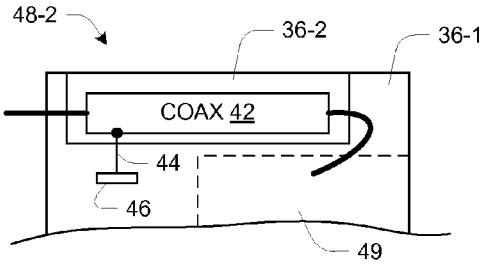
Figure 8:
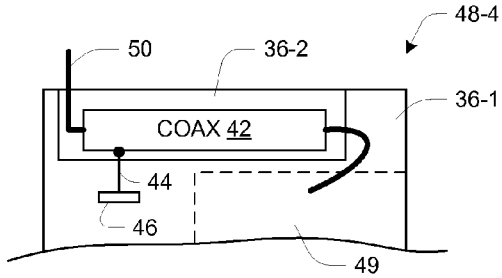

Jack 48-2 of FIG. 6 is similar to jack 48-1 except that the body 36 is an assembled unit having a main body portion 36-1 and a separate portion 36-2 in which the coax 42 is embedded or affixed. The jacks 48-3 and 48-4 of FIGS. 7 and 8 are similar to those of FIGS. 5 and 6 except for the location of the back-end exposed area 50, being at the bottom of the body 36 in jack 48-3 and at the top of the body 36 in jack 48-4.

Figure 9:
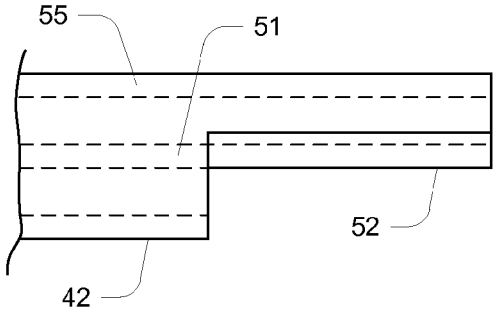
FIGS. 9 and 10 are a side view and end view respectively of a mating portion of a coaxial conductor.
Figure 10:
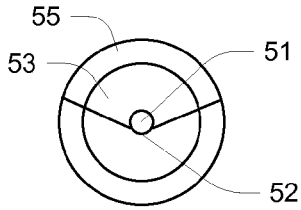
Figure 11:
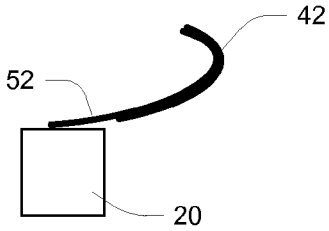
FIG. 11 is a schematic side view showing the mating between a coaxial conductor and a contact of a plug.

FIGS. 9-11 illustrate one way in which the mating ends of the coax conductors 42 of a jack 48 may be configured to effect a mating contact with mating connections on a plug. FIG. 9 shows a side view of a coax 42, while FIG. 10 shows an end view, and FIG. 11 illustrates the mating end of a coax 42 making contact with a contact 26 of a plug. The coax 42 has a center conductor 51, insulating spacer 53, and outer shield conductor 55. An outer insulating jacket is omitted from the figures. At the mating end of the coax 42, the bottom part of the insulating spacer 53 and outer shield conductor 55 are stripped away, leaving an exposed area 52 of the center conductor 51. In use as shown in FIG. 11, the mating end of the coax 42 flexes slightly and the exposed area 52 is in forced contact with the contact 26 of the plug.

One side benefit to having a grounded shield conductor 55 is the possibility of safely discharging any static electricity that may have collected on a cable and thereby avoiding an unsafe discharge via the signal conductors that could damage circuitry connected thereto. An earlier technique for providing protection from such transient discharges is shown in U.S. Pat. No. 5,947,773 entitled "Connector With ESD Protection". That scheme employs two sets of conductors in a jack, a regular set of signal conductors and a separate set of grounded conductors placed in front of the signal conductors. As a plug of a cable is inserted into the jack, it first encounters the grounded conductors which discharge any static charge present on the cable. Further insertion breaks the connections with the grounded conductors and makes the normal signal connections with the signal conductors. The structure of FIGS. 9-11 may be used in a similar fashion, with the outer shield conductor 55 serving as the first-encountered grounding conductor. As the contacts 26 slide along the outer shield conductor 55 of the coax 42 before they mate to the center conductors 51, it provides relief of transient discharges to the attached electronics.

Figure 12:
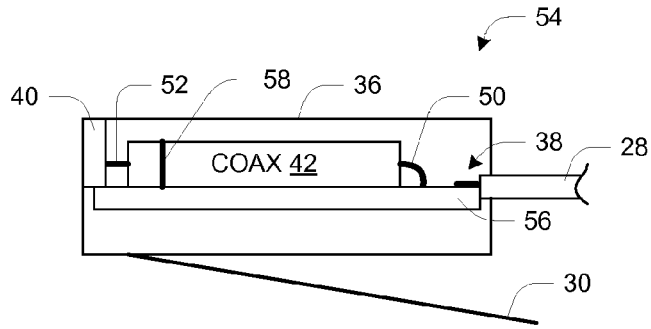
FIG. 12 is a schematic side view of a modular plug employing coaxial conductors.

FIG. 12 is a schematic side view of a configuration of a plug 54 according to the general configuration of FIG. 4. The coax 42 is disposed on a planar substrate 56 and disposed within the body 36 (such as within a cavity accessible from one end for example). Exposed areas 50, 52 of the center conductor are connected to the back-end and mating connection points 38, 40 respectively (see FIG. 4). The back-end connection points 38 are configured for connection to the conductors of the cable 28, such as by soldering or IDC connection, and the mating connection points 40 are configured to contact corresponding mating connection points of a separate jack (not shown), such as the mating configuration shown in FIG. 2. The mating connection points 40 correspond to the contacts 26 in FIGS. 1 and 2.

Figure 13:
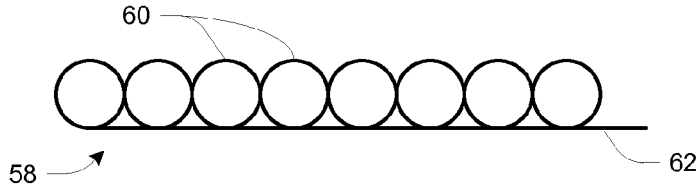
FIG. 13 is an end view of a conductive structure used on the modular plug of FIG. 12.

FIG. 12 also shows one end of a conductive structure 58 which is used to provide the high-frequency AC ground for the shields of the coaxial conductors 42. The configuration of the conductive structure 58 is shown in FIG. 13. It consists of a plurality of adjacent rings 60 which are mechanically and electrically joined together. Each ring 60 receives a corresponding coax 42, making a tight connection between an inner surface of the ring 60 and the outer shield of the coax 42. One or more additional conductive elements 62 may be used to connect the rings 60 to other circuitry, such as the contact(s) 46 shown in FIG. 4.

Although in the above description, the coax 42 is described as having circular cross section, it will be appreciated that in alternative embodiments it may have a cross section of a different shape, such as rectangular or elliptical, or circular with a flat top.

Figure 14:
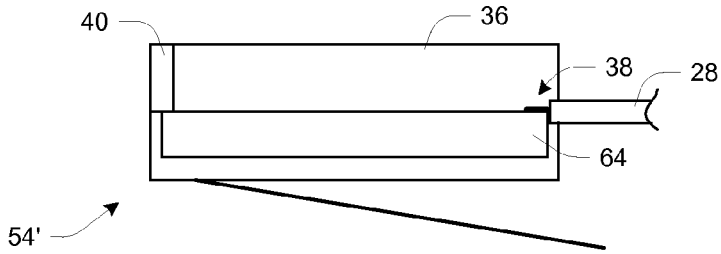
FIG. 14 is a schematic side view of a modular plug employing a multi-layer printed circuit board.
Figure 15:
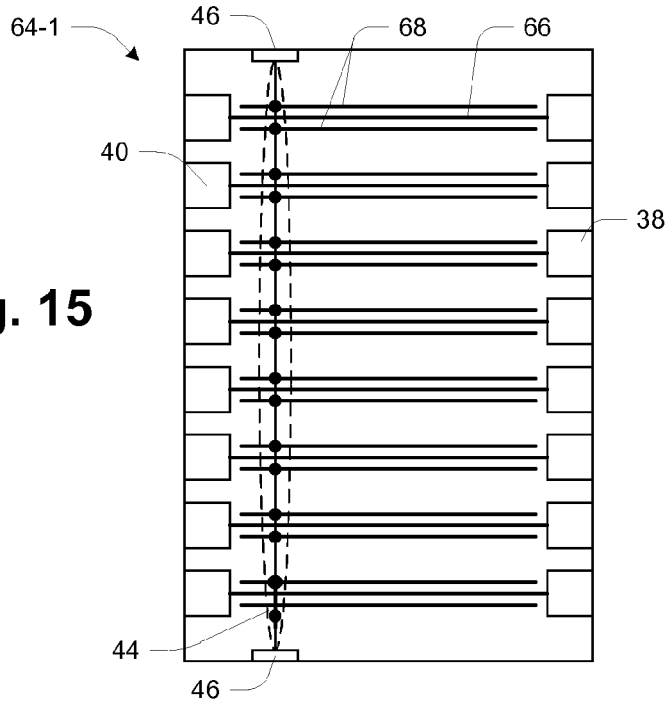
FIGS. 15-17 are schematic views of printed circuit boards usable in a module plug.
Figure 16:
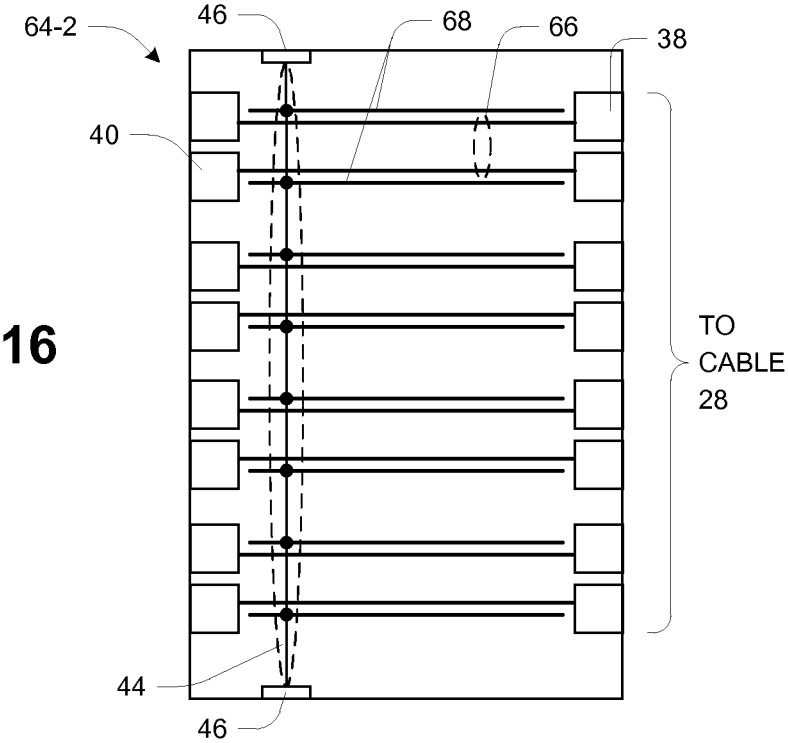

FIG. 14 shows an alternative plug 54' which uses a multiple-layer PC board 64 to make the connections between the mating connection points 40 and the back-end connection points 38. The connections can be made in any of a variety of ways which may address some or all of the above-discussed noise problems. Specific examples are shown in FIGS. 15 and 16. In FIG. 15, a first PC board 64-1 has a set of signal traces 66, each providing a connection between corresponding back-end connection point 38 and mating connection point 40. Each signal trace 66 is flanked by two shield traces 68, and all the shield traces 68 are connected to a conductive structure 44 as described above with reference to FIG. 4. In FIG. 16, a second PC board 64-2 employs a pair of shield traces 68 around each pair of signal traces 66. Also ground planes may exist to further shield all signal traces. For the plug, similar concepts as described in the case of the coax based plug would apply (for ground access and cable access). Folding the ground and crimping at the interface 28 into the cable while interface 40 would be connected at the time the manufacturing of the plug takes place. This again, enables the crimping of such a plug in the field via a special tool at a second terminal as shown in FIG. 18 below. And again, staggering the crimp contacts of the pairs in distance as also shown in FIG. 18 would help alleviate pair-pair crosstalk in the 28 interface as described earlier. Additionally, embedding ground separation among the teeth of terminal 1 per FIG. 18 would insure backward compatibility yet deliver improved isolation and electrical characteristics/performance. With the presence of a PCB and a ground a lot of high-speed signal integrity techniques would be available.

Figure 17:
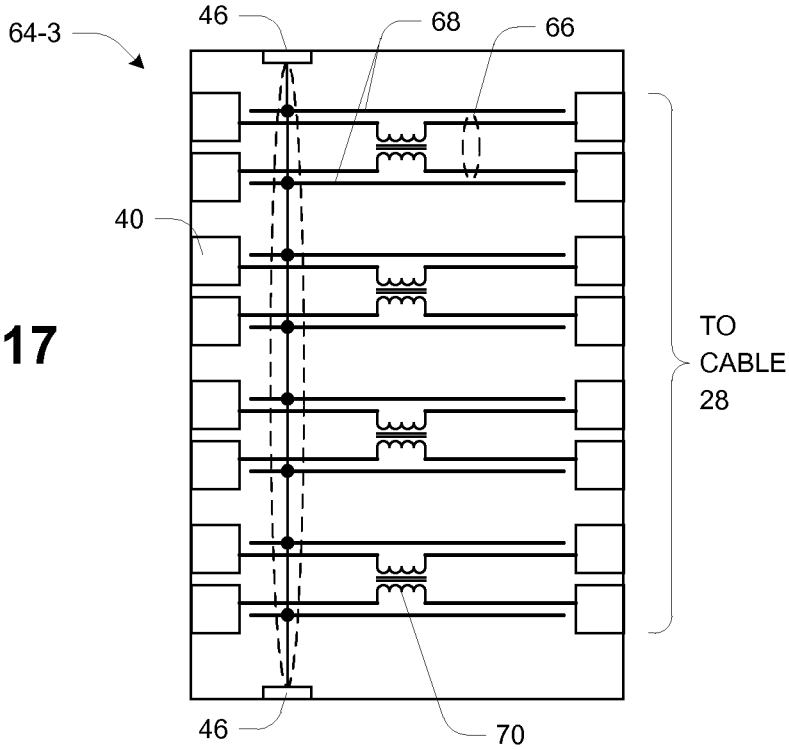

FIG. 17 shows a third PC board 64-3 which incorporates circuitry in addition to the signal and shield traces 66, 68. Specifically, series inductors or "chokes" 70 are included on the signal traces 66 as shown. The chokes 70 serve to reduce the coupling of high-frequency common-mode signals from the cable 28 to the mating connection points 40. It will be appreciated that the chokes 70 or other noise suppression circuitry may also be used without the presence of the shielding conductors 68. Again pair 2 crossing may be done either on the PCB or in the choke if the choke is a single package.

The above discussion regarding the manner of connection to the connection points 40 is likewise applicable to FIGS. 16 and 17.

FIG. 18 shows a plug 72 which includes a first or front housing 74, a printed circuit (PC) board 76 and a second or rear housing 78. FIG. 18 is an exploded view—when fully assembled, a front portion of the PC board 76 resides within the housing 74 beneath a first set of terminals 80, and a rear portion of the PC board 76 resides within the housing 78 beneath a second set of terminals 82, it is effectively a single plug broken into two prices for clarity. A twisted-pair cable 28 attaches via the rear of the rear housing 78. The electrical configuration is as shown in FIG. 14, with the PC board 76 corresponding to the PC board 64, and the contacts 38, 40 corresponding to the terminals 82 and 80 respectively. The terminals 80 may be soldered or press-fit into contacts of the PC board 76. The terminals 82 make contact with both the conductors of the cable 28 as well as corresponding contacts on the PC board 82. It will be noted that the terminals 82 have a staggered configuration in which the two terminals for each differential signal pair from the cable are located together and spaced apart from the terminals of the other differential signal pairs. In one configuration the required splitting of PAIR 2 is accomplished in the PC board 76, so that the twisted pairs from the cable 28 are routed straight to corresponding ones of the terminals 82 without any untwisting or cross-over. The PC board 76 may be configured in any of a variety of ways including the configurations shown in FIGS. 15-17. Alternatively, a configuration using coax such as shown in FIG. 12 may be used, with the PC board 76 serving as the substrate 56.

Figure 19:
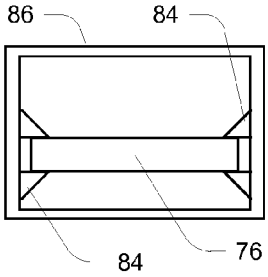
FIGS. 19-21 are end views of conductive jackets of housings with extensions for making ground contact to other components.
Figure 20:
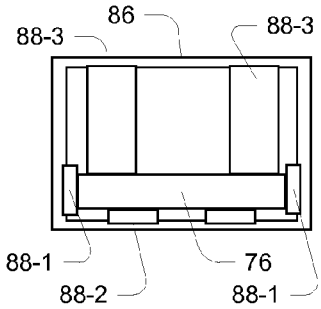

It will be appreciated that either/both the housing 74, 78 may employ an outer conductive shield, even when used with UTP cables where the cable itself is not shielded. The metal jacket that connects the plug to the ground of the system (e.g., via tabs 17 of the jack as shown in FIG. 1) can be extended in some manner to enable the delivery of a ground connection to the PC board 76. FIGS. 19-20 show different ways in which this delivery of a ground to a PC board 76 can be accomplished. In FIG. 19, portions 84 of a metal jacket 86 of the housing 74 are folded inwardly and make contact with conductive contacts on the PC board 76. FIG. 20 shows a configuration in which tabs 88 extend inwardly from the jacket 86 to contact the PC board 76. The tabs are shown in three groups—side tabs 88-1, bottom tabs 88-2 and upper tabs 88-3. It will be appreciated that not all groups may be necessary in all embodiments. For example, in one embodiment the upper tabs 88-2 may be sufficient both to provide adequate ground as well as mechanically hold the PC board 76 in place within a cavity of the housing 74.

Figure 21:
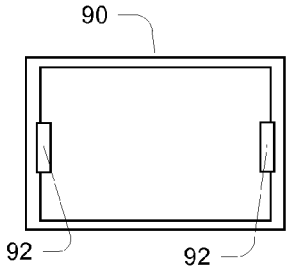

FIG. 21 shows a jacket 90 of the housing 78 which receives the cable 28. Tabs 92 are folded to contact the contacts 17 of a jack 10.

Contacts 18 may be designed differently, where their area is reduced while delivering similar contact surface area, and coax connection are made to the PCB below where the 3,6 crossover is made.

Figure 22:
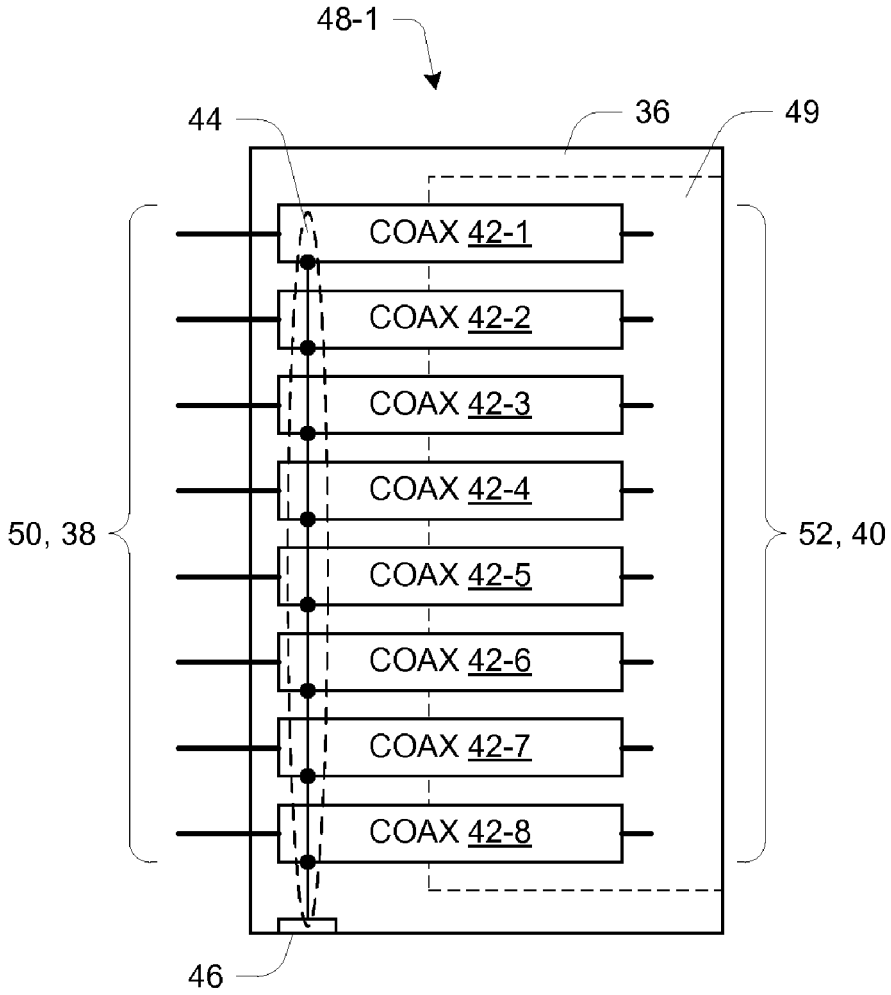
FIG. 22 is a top view of a connector employing coaxial conductors.

FIG. 22 is a top view of the jack 48-1 of FIG. 5, showing 8 coaxial conductors 42 arranged side by side. Also shown is the conductive structure 44, 46 that effects grounding of the outer shield conductor of each coaxial cable 42. The very ends of the exposed areas 52 of the mating connection points 40, shown as extending downwardly into cavity 49 in FIG. 5, extend into the plane of FIG. 22 and are therefore not visible.

While various embodiments of the invention have been particularly shown and described, it will be understood by those skilled in the art that various changes in form and details may be made therein without departing from the spirit and scope of the invention as defined by the appended claims.

For example, although the PC boards 64 as illustrated do not show any cross-over of conductors, it will be appreciated that alternative PC boards may provide a desired cross-over among the signal traces 66 as necessary or desired.

Additionally, it should be noted that the connector 34 may include an exterior conductive shield member to provide shielding from electromagnetic interference. In this case the conductive structure 44 may be connected to such an external shield (either directly or capacitively). For example, the contact 46 may be at an edge of the substrate 56 or PC board 64 and make direct contact with the exterior shield or an inward-facing extension of it.

What is claimed is:

1. A multiple-coaxial conductor modular connector comprising:

a rigid insulating body having a back-end portion and a mating portion, the back-end portion configured to provide connections to a separate printed circuit board or cable, the mating portion configured to permit mating with a mating modular connector;

an array of spaced-apart coaxial conductors carried by the body and extending between the back-end portion and the mating portion of the body, each coaxial conductor having an inner signal conductor surrounded by an outer shield conductor, each coaxial conductor having a mating end at the mating portion of the body, the mating end being configured to provide for electrical connection between the inner signal conductor and a corresponding conductor of the mating modular connector; and one or more conductive structures extending between the respective outer shield conductors of the coaxial conductors and one or more reference contacts at an outer surface of the body;

wherein the inner signal conductor is made of a springy conductive material, and wherein the mating end of each coaxial conductor has a length of the inner signal conductor exposed, the exposed inner signal conductor being configured to be deflected into resting contact with a corresponding conductor of the mating modular connector;

wherein the length of exposed inner signal conductor of each coaxial cable is folded backward at an angle greater than 90 degrees so as to be deflected rearward into the resting contact.

2. A multiple coaxial modular connector according to claim 1, wherein the outer shield conductor of each coaxial conductor is removed at the mating end to expose the inner signal conductor.

3. A multiple coaxial modular connector according to claim 1, wherein the mating modular connector forms a plug and the body is configured to include a cavity for receiving the plug, and wherein the mating portion of the body is a portion adjacent to the cavity and to a corresponding surface of the plug when mated with the multiple-position modular connector.

4. A multiple coaxial modular connector according to claim 1, wherein the mating modular connector forms a jack defining a cavity, the body is configured as a plug for insertion into the cavity, and the mating portion of the body is a portion adjacent to a corresponding cavity-defining surface of the jack when mated with the multiple-position modular connector.

5. A multiple coaxial modular connector according to claim 1, wherein the mating modular connector forms a plug and the body is configured to include a cavity for receiving the plug, and wherein the length of exposed inner signal conductor of each coaxial cable extends into the cavity so as to make wiping contact with a corresponding contact of the plug when mated with the multiple-position modular connector.

6. A multiple coaxial modular connector according to claim 5, wherein the mating modular connector forms a jack defining a cavity and the body is configured as a plug for insertion into the cavity, and wherein the length of exposed inner signal conductor of each coaxial cable extends from the mating portion so as to make wiping contact with a corresponding contact at a cavity-defining surface of the jack when mated with the multiple-position modular connector.

* * * * *